US005382066A

United States Patent [19]

Kelly

[11] Patent Number: 5,382,066

[45] Date of Patent: Jan. 17, 1995

[54] MECHANISM FOR LIFTING FREIGHT CONTAINERS

[75] Inventor: Thomas P. Kelly, Colleyville, Tex.

[73] Assignee: The Atchison, Topeka & Santa Fe Railway Company, Euless, Tex.

[21] Appl. No.: 126,038

[22] Filed: Sep. 23, 1993

[51] Int. Cl.[6] ..... B66C 1/66

[52] U.S. Cl. ..... 294/68.3; 294/81.54; 294/119.1

[58] Field of Search ..... 294/67.3, 67.33, 68.1, 294/68.3, 81.2, 81.1, 81.21, 81.54, 81.6, 81.62, 119.1, 907, 88; 414/459, 460, 560, 607

[56] References Cited

U.S. PATENT DOCUMENTS

| | | | |
|---|---|---|---|
| 1,485,972 | 3/1924 | Fitch | 294/68.3 X |
| 2,136,443 | 11/1938 | Kepler . | |
| 2,472,939 | 6/1949 | Connolly . | |
| 2,547,502 | 4/1951 | Smith et al. | 294/68.3 |
| 2,796,283 | 6/1957 | Grazier | 294/68.3 |
| 2,904,370 | 9/1959 | Meinholtz et al. | 294/68.3 |
| 3,086,807 | 4/1963 | Russell et al. . | |
| 3,262,729 | 7/1966 | Willison et al. . | |
| 3,567,266 | 3/1971 | Bridge et al. . | |
| 3,663,052 | 5/1972 | Schurch . | |
| 4,252,358 | 2/1981 | Klebs | 294/67.33 |
| 4,358,145 | 11/1982 | Svensson . | |
| 4,546,891 | 10/1985 | Lanigan et al. . | |
| 4,693,017 | 9/1987 | Oehler et al. | 294/68.3 X |
| 4,778,209 | 10/1988 | Zosky et al. . | |

FOREIGN PATENT DOCUMENTS

| | | | |
|---|---|---|---|
| 8201182 | 4/1982 | WIPO | 294/67.33 |

*Primary Examiner*—Dean J. Kramer

[57] ABSTRACT

This invention relates to devices for lifting containers such as freight containers using structures having bearing apertures mounted on the containers, such structures to be engaged by lifting devices which enter the bearing apertures add are brought to bear against such structures to permit lifting and movement of the containers in a more efficient manner than is currently known.

3 Claims, 2 Drawing Sheets

Fig. 1
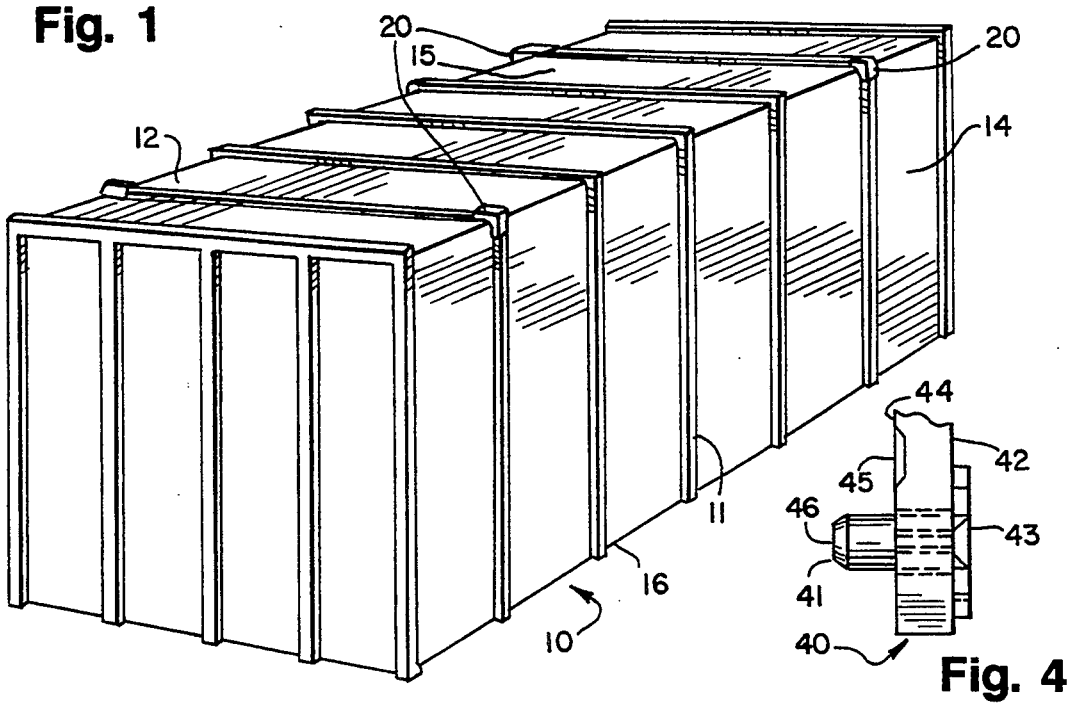
Fig. 4
Fig. 2
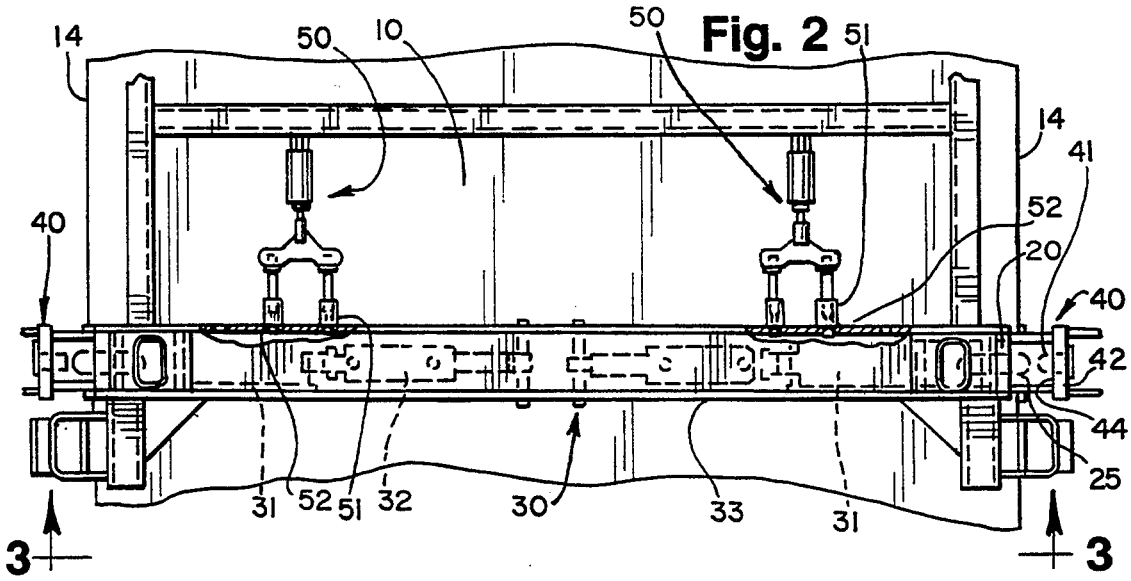
Fig. 3
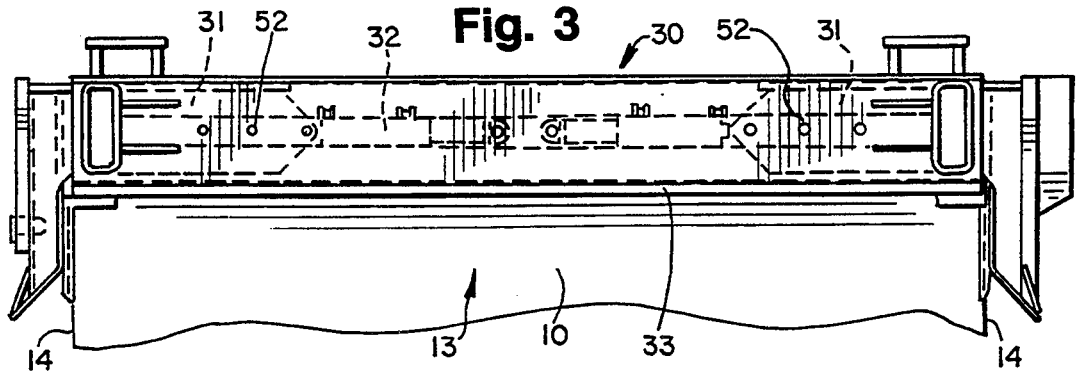

Fig. 5
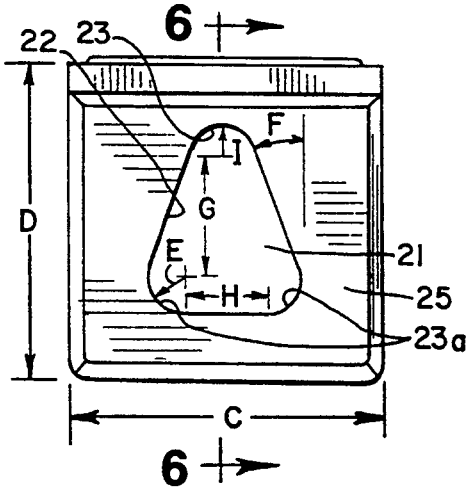
Fig. 6
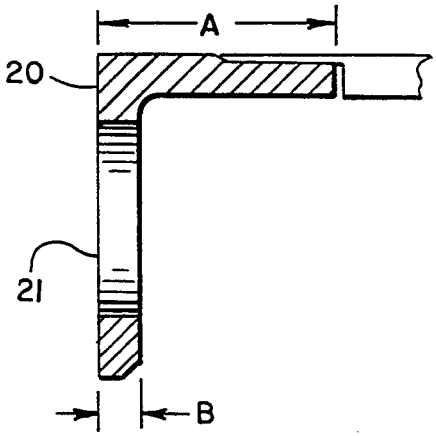
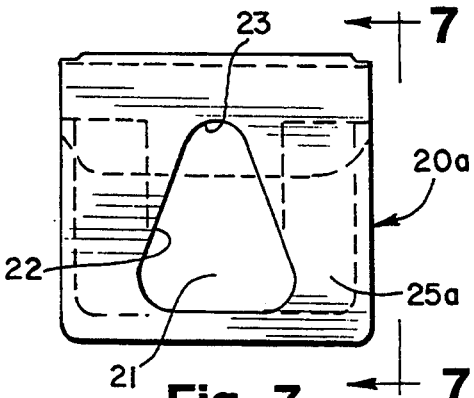
Fig. 7
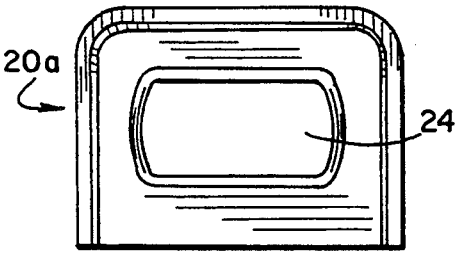
Fig. 9
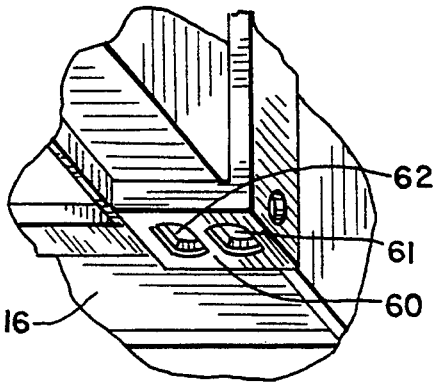
Fig. 10
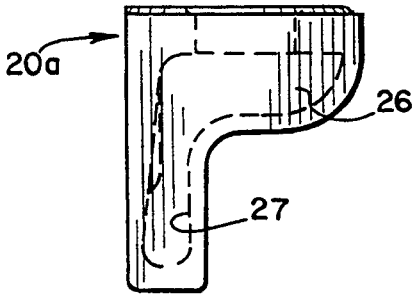
Fig. 8

MECHANISM FOR LIFTING FREIGHT CONTAINERS

BACKGROUND OF THE INVENTION

The present invention relates in general to a lifting device and, in particular, to a device for lifting large containers.

More specifically, but without restriction to the particular use which is shown and described, a first embodiment of the present invention relates to a lifting device including an aperture and bearing surface that allows freight containers to be lifted and moved without limiting or restricting the interior volumetric space of the container. The mechanism which forms the aperture and bearing surface is mounted on the container so as to transfer the lifting forces into the container's structural frame.

Although it will be recognized that the present invention can facilitate lifting many different kinds of freight containers, the present invention has particular applicability to freight containers used as part of intermodal systems. In such systems freight containers are moved between destination points using two or more different modes of transportation. For example, a typical intermodal system moves freight containers on truck trailers and flat bed railroad cars. The freight containers used in intermodal systems are specifically designed to be interchangeable with different modes of transportation systems.

Freight containers commonly used heretofore in intermodal systems have employed a plurality of bearing mechanisms which extend or are built into the interior volumetric space of the container in the upper and/or lower corners within the container. These bearing mechanisms contain apertures which can be engaged by a variety of structures and devices suitable for lifting such containers.

One of the devices presently used to lift containers in intermodal transport systems may be described generally as a twist-lock bayonet mechanism. This known mechanism utilizes "T-shaped" lift members which are inserted through an oval aperture in castings positioned either on the sides or on top of the container. Once the flange of the T-shaped member is inserted through the aperture, it is rotated ninety degrees so that the axis of symmetry of the flange of the T-shaped member is aligned normal to the long axis of symmetry of the oval aperture. In this position, the T-shaped member bears against the lift casting to facilitate lifting of the container without disengagement.

One example of a twist-lock bayonet lifting mechanism using a rotatable T-shaped member is disclosed in U.S. Pat. No. 4,358,145, entitled: "*Lifting Device For Container*". This prior lifting mechanism, however, has at least the following principal disadvantages: (i) it is difficult to properly align the T-shaped member with the aperture of the bearing mechanism so that the T-shaped member may penetrate through the aperture without contacting the surface of the bearing mechanism, to avoid causing excessive wear on the surfaces of the T-shaped member or on the bearing mechanism; (ii) the T-shaped member must be rotatable, thus requiring a more complicated mechanical design; and (iii) the bearing mechanism containing the aperture must be fabricated with an internal cavity sealed from the interior space of the container to allow sufficient depth behind the aperture to permit the penetration of the T-shaped member and its rotation. Thus, existing bearing mechanisms of this type are constructed in a box-shape, and intrude into and reduce the interior volumetric space of the container.

Other previously known lift devices have employed lift members using elongated pills rather than rotatable T-shaped members. These lift members facilitate lifting of a container by insertion into bearing mechanisms located on the sides of the container. Such lift members, however, have no means of interlocking with the bearing lift casting to prevent inadvertent disengagement during lifting. The lift members, therefore, must be long enough and inserted to a depth beyond the aperture of the bearing mechanism so that during lifting, the container will not slide-off the end of the lift member. Such a device, therefore, requires that the bearing mechanism intrude upon and reduce the interior volumetric space of the container to an even greater degree than the bearing mechanism required for a lifting member of the known T-shape described above.

The present invention overcomes the disadvantages of the above noted existing devices by eliminating the need for a mechanism to rotate the end member, by avoiding intrusion on and reduction of the interior volumetric space of the container, and, also, by preventing inadvertent disengagement of the lift member from the bearing mechanism.

U.S. Pat. No. 3,567,266, entitled "*Freight Container And Gripping And Lifting Attachment Therefore*", illustrates an additional device for lifting freight containers. In that invention, a uniquely shaped socket is formed in a rectangular lift member affixed to a container in recessed portions of the container side walls. Lift blocks are inserted into the sockets. The lift blocks are shaped to fit within the sockets in a rotational manner so that the lift block is retained by the shape of the socket to prevent disengagement during lifting.

The present invention, however, represents an improvement over that shown in U.S. Pat. No. 3,567,266. First, the present invention eliminates the need for the rotational connection between the lift block and the lifting tongue. Second, the present invention eliminates the need both for a retainer gib in the socket and a shoulder on the lift block. This allows for easier tooling because the tolerance between the lifting member and the aperture of the present invention is greater, and the parts do not have to match as closely as in the invention disclosed in the patent. In addition, the construction of the present invention can be formed integral with the structural frame of the container, thus avoiding the need for recesses in the container side walls.

SUMMARY OF THE INVENTION

The present invention comprises a device for lifting freight containers from a position exterior to the container utilizing bearing and lifting elements that do not intrude into or reduce the container's interior volumetric space in any manner. This invention also may be used in connection with the coupling of containers in stacked relation with one another enabling substantially reduced intrusion into the container's interior space necessitated by such lifting implements as compared with prior lifting devices.

The devices of the present invention comprise a plurality of lift members constructed for use in connection with a spreader assembly, to engage a plurality of bearing mechanisms on a freight container and to lift such container. The bearing mechanisms are mounted on the exterior of the freight container or are fabricated to be attached to the structural frame of the container.

In operation, at least one lift member is aligned opposite the bearing mechanism and the lift member is moved normal to and toward the side walls of the container until it is positioned within an aperture formed in the surface of the bearing mechanism. Then, the lift member is fixed in position relative to the container by operation of the spreader assembly to prevent inadvertent withdrawal of the lift member from the aperture. Thereafter, the lift member is raised until it engages the apex of the aperture. As the lift member continues upward, it bears against the inner surface of the apex of the aperture and the container is lifted.

DESCRIPTION OF DRAWINGS

FIG. 1 is a perspective view showing a typical container having bearing mechanisms located thereon in accordance with the present invention;

FIG. 2 is a partial top plan view showing a lift assembly positioned above the top of the container illustrated in FIG. 1 with a spreader assembly having extendable arms aligned to enable engagement of locking knobs in the bearing mechanisms for lifting the container and with safety locks to maintain the arms in fixed position;

FIG. 3 is a partial cross-sectional view taken along line 3—3 in FIG. 2;

FIG. 4 is an enlarged side elevational view of a lift member including a locking knob as shown in FIG. 2 which facilitates coupling of the lifting assembly and the bearing mechanism according to the present invention;

FIG. 5 is a front elevational view showing a first embodiment of a bearing mechanism according to the present invention as employed on the container shown in FIG. 1;

FIG. 6 is a cross-sectional view of the bearing mechanism taken along line 6—6 of FIG. 5;

FIG. 7 is a front elevational view of a second embodiment of a bearing mechanism constructed with a top inter-box aperture according to the present invention to enable interconnection of two containers similar to the container illustrated in FIG. 1 which are in stacked relation to one another;

FIG. 8 is a cross-sectional view taken along line 7—7 in FIG. 7 of the second embodiment of the bearing mechanism according to the present invention with an aperture, a top inter-box aperture and a cavity;

FIG. 9 is a top plan view of the second embodiment of the bearing mechanism shown in FIG. 7 illustrating an inter-box aperture according to the present invention; and FIG. 10 is a partial bottom perspective view of an inter-box casting with inter-box apertures mounted on the bottom of the container to enable coupling of stacked containers according to the present invention.

DESCRIPTION OF THE INVENTION

Referring more particularly to the drawings and as best illustrated in FIG. 1, a freight container utilizing the present invention is indicated by the reference 10. In general, the freight container 10 is of an intermodal type that may be transported by different modes of transportation including truck, railroad and ship.

The container 10 has an interior 13 (shown in FIG. 3) defined by side walls 14, a top 15 and a bottom 16. The container 10 is constructed with side posts 11 and header beams 12. The container 10 is provided with a plurality of bearing mechanisms 20, each located generally at the intersection of a side post 11 and a header beam 12 of the container 10.

Referring to FIGS. 2 and 3, a spreader assembly 30 with extendable arms 31, capable of extending and retracting horizontally, is positioned over the container 10. The spreader assembly 30 may be mounted on a conventional overhead traveling carriage or may be extended from a conventional hoist or side lifting truck of known design.

The extendable arms 31 are equipped with hydraulically powered elements 32 which operate to horizontally extend and retract each of the arms 31 relative to the side walls 14 of the container 10. The spreader assembly 30 also employs safety locks 50 which are used to maintain the extendable arms in a fixed position relative to the spreader assembly frame 33 and the container side walls 14.

As best illustrated in FIG. 4, the lift member 40 includes a locking knob 41 which may be secured in any known manner such as by use of a locking element 43 to the lifting section 42 of extendable arm 31. In a preferred embodiment of the invention, knob 41 extends approximately $\frac{7}{8}$-inch from the inner face 44 of section 42, and is approximately $1\frac{1}{2}$-inch in diameter. A known position sensor 45 may also be mounted on the inner face 44 of section 42 on lift member 40 to sense when inner face 44 is in contact with outward face 25, **25*a* of bearing mechanism 20, 20*a***.

Safety locks 50, best illustrated in FIG. 2, include a plurality of hydraulically powered locking pins 51 which project into locking portals 52 formed reciprocally in the surface of frame 33 of spreader assembly 30 and in the extendable arms 31, to prevent relative movement between the frame of the spreader assembly 30 and the extendable arms 31. It will be recognized that the safety locks 50 can be fabricated from various plastic and metal components and in a variety of known designs including the positive mechanical pin lock 50 described herein. Exemplary of other suitable lock designs are worm gear mechanism and self-securing hydraulic devices. Likewise, any mechanism for fixing the movement of the extendable arms 31 relative to the spreader assembly frame 30 to prevent disengagement of the locking knob 41 from the bearing mechanism 20, **20*a*** will accomplish the objectives of the present invention.

The bearing mechanism 20 best illustrated in FIGS. 5 and 6 is formed as an angle with an aperture 21. The bearing mechanism 20 is attached as shown in FIG. 1 to the side post 11 and header beam 12 of freight container 10, for example, by welding so as to allow the lifting forces to be transferred into the structural frame of the container 10 without limiting or restricting the volumetric capacity of or the working space in the interior 13 of the container 10.

Bearing mechanism 20 is fabricated in a present embodiment with top width A being 6 inches and thickness B being $1\frac{1}{8}$ inch (including a cover plate), a front width C of 8 inches and a height D of 8 inches.

The aperture 21 of bearing mechanism 20 is formed having a prescribed depth so that knob 41 can project into the aperture 21 a sufficient distance to allow lifting of the container 10 without enabling the tip 46 of the knob 41 to engage the side wall 14 of the container 10. Aperture 21 is formed with arcuately shaped inner surfaces 22 further forming an apex 23. The inner surfaces 22 can act as a guide to position knob 41 as it is moved upward into engagement with apex 23.

Aperture 21 of bearing mechanism 20 is fabricated in a present embodiment with bottom corners 23*a* having a radius E of 0.890 inches, arcuately shaped inner surfaces 22 formed at an angle F of 32.57° from vertical, a height G of 3 1/32 inches, a width H of 3¼ inches, and an apex 23 having radius I of 0.890 inches.

A second embodiment of the present invention is provided herein which is designed for connecting with stackable containers placed one on top of the other, for example, in transport by rail or ship. The bearing mechanism 20*a* of this second embodiment is best illustrated in FIGS. 7, 8 and 9. Bearing mechanism 20*a* includes an aperture 21 with inner surfaces 22 and apex 23 as formed in the first embodiment of bearing mechanism 20 of the present invention illustrated in FIGS. 5 and 6. Bearing mechanism 20*a*, however, also comprises a top inter-box aperture 24 of known, standard dimension and location so as to mate with a bottom inter-box casting 60, shown in FIG. 10, mounted on the bottom of another stackable container 10. In this second embodiment, bearing mechanism 20*a* includes an interior cavity 26 formed by rear walls 27 to seal the cavity from the interior 13 of container 10. Because knob 41 does not project through the aperture 21 during lifting of the container 10, the volume of cavity 26 can be greatly reduced over the volume of cavities used in the prior art, thereby reducing the intrusion into and reduction of the volumetric capacity of the interior 13 of said container 10 by the bearing mechanism 20*a*. The cavity 26 need only be large enough to facilitate the inter-box connection of stacked containers without requiring additional space for lifting the container 10.

A bottom inter-box casting 60 is best illustrated in FIG. 10. This casting 60 comprises a first and second inter-box aperture 61 and 62, respectively of standard size and configuration. Castings of the prior art contained only one of said apertures. However, the present invention utilizes dual apertures to facilitate the connection between a container 10 of the present invention with bottom inter-box casting 60 and a container of known design having bearing mechanisms with known, standard larger cavities or a container of the present invention having top inter-box aperture 24 and top inter-box cavity 26. Thus, the second embodiment of the present invention enables containers 10 to be stacked with other containers whether constructed according to the present invention or constructed of known, standard design.

In operation, spreader assembly 30 is positioned above freight container 10. Pairs of extendable arms 31 are positioned in parallel relationship to each other so that each arm 31 is aligned vertically above a pair of bearing mechanisms 20 or 20*a*, located on opposing sides of said container 10.

With the spreader assembly 30 in such position, the spreader assembly is lowered to a point where each knob 41 is directly opposite an aperture 21 of the bearing mechanisms 20 or 20*a*. Each pair of extendable arms 31 is horizontally retracted in a reciprocating manner by a known hydraulically powered mechanism 32 until each knob 41 is within an aperture 21. The reciprocating retraction of the pairs of extendable arms 31 may be stopped by use of a known sensor 45, if desired, that is interlocked with the hydraulic drives 32 which operate to retract extendable arms 31. When a knob 41 has completely entered an aperture 21 so that inner face 44 of section 42 is nearly engaged with the side post 11 of the container 10, the sensor 45 will cause a signal to be sent further causing shut-off of the related hydraulic drive 32. At the same time, the sensor 45 will cause activation of locking pin mechanism 50 which will extend locking pins 51 through locking portals 52 on the spreader assembly frame 30 and extendable arms 31 so as to prevent unintentional disengagement of the knob 41 from the bearing mechanism 20*a*. It will be recognized that the portals 52 on the spreader assembly 30 and the extendable arms 31, respectively, must be located to permit engagement by the locking pins 51 at the point where the sensor 45 signals that inner face 44 is nearly engaged with the side post 11 of container 10.

With knob 41 inside aperture 21 of bearing mechanism 20 or 20*a*, knob 41 is raised into engagement with inner surfaces 22 of aperture 21. As the knob 41 is raised, it will be guided by said inner surfaces into position to bear against apex 23 of aperture 21. When each of knobs 41 is raised to bear against an apex 23, and as the knobs 41 are raised further, container 10 is raised from its resting position. Said container then may be moved as desired by the operator.

If the operator desires to stack the container 10 onto another container, either of the present invention or of a known standard design, the operator first will position container 10 above an underlying container. In this position, the bottom inter-box aperture 61 or 62 is aligned above the top inter-box aperture 24 of the present invention or above the top inter-box aperture of the known standard container. A known, standard inter-box fastener is used to couple the containers one upon the other.

In view of the foregoing, it is readily apparent that the lifting mechanism of the present invention provides a superior means by which containers 10 can be lifted and moved in a safe, reliable manner without limiting or reducing the volumetric capacity or the working space of interior 13 of container 10. In the case of containers employing top inter-box apertures, the present invention reduces the reduction or limitation of volumetric capacity or working space of said interior 13 to a minimum.

I claim:

1. A lifting assembly comprising in combination:

a container having a top, a bottom and side walls defining an interior volume;

a plurality of bearing mechanisms affixed to the side walls of the container so as not to reduce the interior volume of the container, said bearing mechanisms each comprising a plate-like structure having an outer face opposite an inner face, each such face defining a plane, and said bearing mechanisms each further including an aperture configured in an arcuate shape defining an apex;

a spreader assembly including a plurality of lift members which are positionable within the apertures of the bearing mechanisms to facilitate lifting the container;

the spreader assembly further including locking mechanisms to prevent inadvertent withdrawal of the lift members from the bearing mechanisms, and also including mechanisms for stopping the movement of the lift members toward the container when the lift members are being positioned within the apertures but before the lift members engage the container; and each lift member comprising a knob movable into the aperture in a direction perpendicular to the side walls of the container, said knob also being movable during lifting so as to be guided by the aperture into engagement with the apex such that forces from the knob are transferred to the bearing mechanism, thereby facilitating lifting of the container, with the knob not penetrating the plane defined by the inner face of the bearing mechanism during said lifting operation.

2. A lifting assembly comprising, in combination:

a container including a top, a bottom, and side walls defining an interior volume;

a plurality of bearing mechanisms affixed to the container, each bearing mechanism defining a cavity sealed from the interior volume of the container, and further including first and second adjacent exterior surfaces which are connected to form an angle, each such surface including an aperture, the first of such apertures being located on the side walls of the container and the second of the apertures located on the top of the container and communicating with the cavity;

the first aperture of the bearing mechanism configured in an arcuate shape defining an apex so that a lift member is guided to the apex of the aperture when the lift member positioned within the aperture is raised;

a spreader assembly including a plurality of lift members which are positionable within the bearing mechanisms to facilitate lifting of the container, and the spreader assembly further including locking mechanisms to prevent inadvertent withdrawal of the lift members from the bearing mechanisms;

the second exterior surface of each bearing mechanism having an inter-box aperture cooperating with a fastener to couple the container to a second container in stacked relation thereabove;

the spreader assembly including a mechanism for stopping the movement of the lift members toward the container when the lift members are being positioned within the aperture, but before the lift members engage the container; and each lift member including a knob projecting into the aperture in a direction perpendicular to the side walls of the container, said knob cooperating with the aperture of said bearing mechanism during lifting so as to be guided by the aperture into engagement with the apex such that forces from the knob are transferred to the bearing mechanism, thereby facilitating lifting of the container.

3. The lifting assembly of claim 2 further comprising:

a casting mounted on the bottom of a first container so as to not reduce the interior volume of the container, the casting defining a bottom cavity and having an exterior face with a first and second bottom inter-box aperture, and said bottom cavity being in communication with the first and second bottom inter-box apertures;

the first bottom inter-box aperture cooperating with a fastener so as to couple the first container to the top of the third container in stacked relation thereunder, said third container including the bearing mechanisms of claim 6; and the second aperture cooperating with the fastener to couple the first container to the top of a fourth container in stacked relation thereunder, said fourth container including a top inter-box aperture.

* * * * *

UNITED STATES PATENT AND TRADEMARK OFFICE

CERTIFICATE OF CORRECTION

PATENT NO. : 5,382,066

DATED : January 17, 1995

INVENTOR(S) : Thomas P. Kelly

It is certified that error appears in the above-indentified patent and that said Letters Patent is hereby corrected as shown below:

Title page
In Abstract:

Line 5, delete "add" and insert --and--

Column 2, line 6, delete "pills" and insert --pins--

Column 6, line 9, insert --20 or-- before "20a"

Signed and Sealed this

Fourth Day of April, 1995

Bruce Lehman

*Attest:*

BRUCE LEHMAN

*Attesting Officer*

*Commissioner of Patents and Trademarks*